US007010829B2

(12) United States Patent
Harman et al.

(10) Patent No.: US 7,010,829 B2
(45) Date of Patent: Mar. 14, 2006

(54) RETRACTABLE HOSE CENTRAL VACUUM CLEANING SYSTEM APPARATUS AND METHOD

(76) Inventors: James Roger Harman, 8706 137th St. NW., Gig Harbor, WA (US) 98929; Rod Drivstuen, 85229 99th Pl. SE., Monroe, WA (US) 98227; Gary Drivstuen, 15408 257th Ave. SE., Monroe, WA (US) 98272

( * ) Notice: Subject to any disclaimer, the term of this patent is extended or adjusted under 35 U.S.C. 154(b) by 0 days.

(21) Appl. No.: 10/861,994

(22) Filed: Jun. 4, 2004

(65) Prior Publication Data

US 2005/0022329 A1 Feb. 3, 2005

Related U.S. Application Data

(60) Provisional application No. 60/476,887, filed on Jun. 5, 2003.

(51) Int. Cl.
*A47L 5/38* (2006.01)

(52) U.S. Cl. ..... 15/315; 15/314; 285/7; 285/302; 55/DIG. 8

(58) Field of Classification Search ..... 15/314, 15/315; 55/DIG. 8; 285/7, 302, 303, 338, 285/196, 216
See application file for complete search history.

(56) References Cited

U.S. PATENT DOCUMENTS

| | | | | |
|---|---|---|---|---|
| 2,919,017 | A * | 12/1959 | Weber | 285/302 |
| 3,023,447 | A | 3/1962 | Senne | |
| 3,213,480 | A | 10/1965 | Miller | |
| 3,568,240 | A | 3/1971 | Hamrick | |
| 3,593,363 | A * | 7/1971 | Hamrick | 15/315 |
| 3,682,500 | A | 8/1972 | Hamrick | |
| 3,958,297 | A | 5/1976 | Hukuba et al. | 15/315 |
| 3,977,038 | A | 8/1976 | Hukuba et al. | 15/315 |
| 4,336,427 | A * | 6/1982 | Lindsay | 15/314 |
| 4,688,292 | A | 8/1987 | Schmiegel | 15/315 |
| 4,688,596 | A | 8/1987 | Liebmann et al. | 137/360 |
| 4,895,528 | A | 1/1990 | Choiniere et al. | 439/191 |
| 5,430,978 | A | 7/1995 | Kohler | 52/27 |
| 5,526,842 | A | 6/1996 | Christensen | 137/360 |
| 5,740,581 | A | 4/1998 | Harrelson, II | 15/314 |
| 5,740,582 | A | 4/1998 | Harrelson, II | 15/315 |
| 6,158,080 | A | 12/2000 | Schlapkohl | 15/301 |
| 6,459,056 | B1 * | 10/2002 | Graham | 15/314 |
| 2001/0022009 | A1 | 9/2001 | Spearman | 15/314 |

FOREIGN PATENT DOCUMENTS

| | | |
|---|---|---|
| CA | 880976 | 9/1971 |

(Continued)

*Primary Examiner*—Theresa T. Snider
(74) *Attorney, Agent, or Firm*—William Forster

(57) ABSTRACT

A retractable hose central vacuum cleaning system comprising a retractable vacuum hose configured to retract through a valve assembly, into a system vacuum pipe responsive to the vacuum communicated from a vacuum source. The valve assembly comprising a static valve seal adapted for coupling a system vacuum pipe to the vacuum hose to create a substantially air-tight sealed communication between the system vacuum pipe and the vacuum hose. The static valve seal being adjustable from a first unsealed configuration where the vacuum hose can move freely through the valve assembly and system vacuum pipe, to a second sealed configuration where the vacuum hose is in sealed communication with a system vacuum pipe, and where the vacuum hose is substantially fixed in relative position to the valve assembly. Wherein movement from first configuration to the second configuration locks the vacuum hose in place relative to the valve assembly.

23 Claims, 10 Drawing Sheets

FOREIGN PATENT DOCUMENTS

| | | |
|---|---|---|
| CA | 881627 | 9/1972 |
| CA | 908915 | 9/1972 |
| EP | 0399991 A1 | 5/1990 |
| WO | WO 0124677 A1 | 4/2001 |

* cited by examiner

FIG. 9
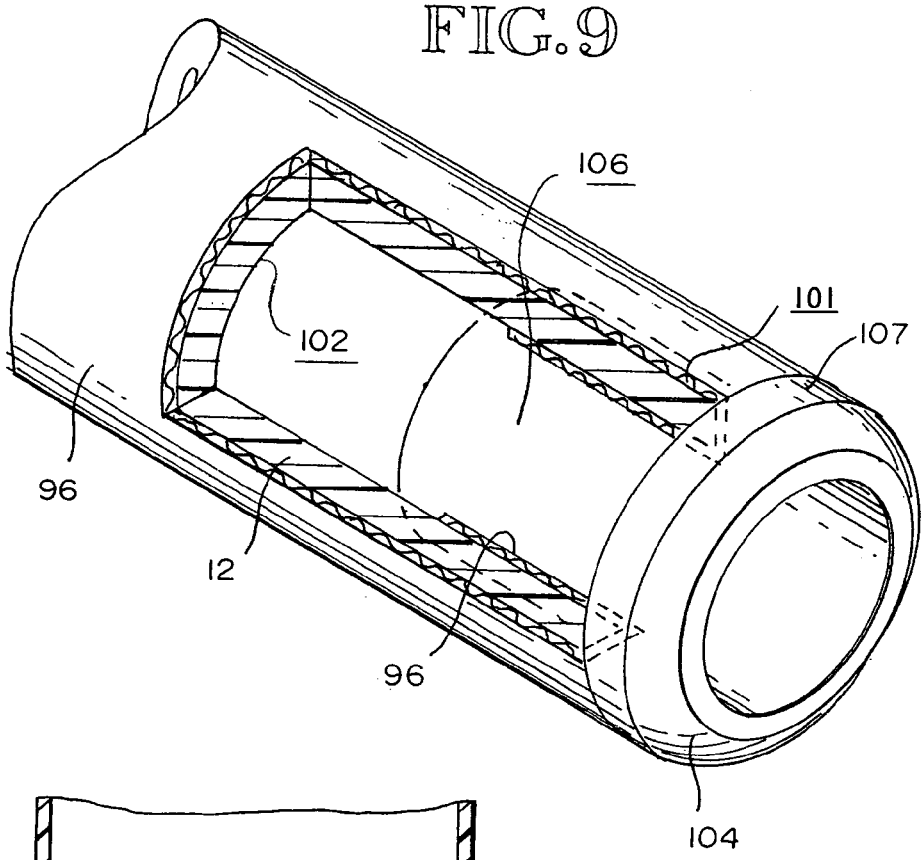
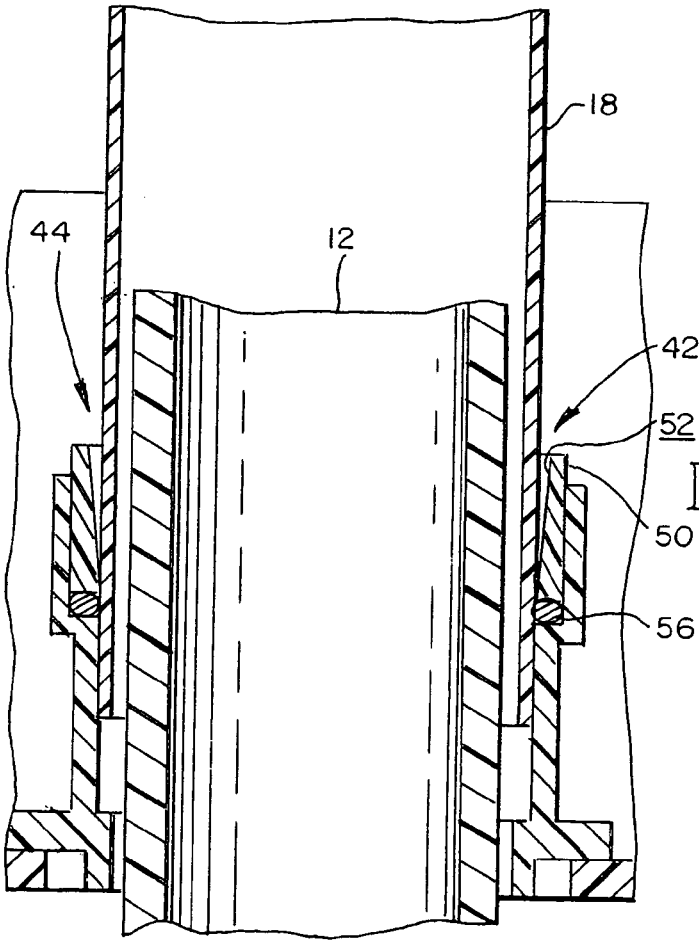
FIG. 10

RETRACTABLE HOSE CENTRAL VACUUM CLEANING SYSTEM APPARATUS AND METHOD

This application claims the benefit of U.S. Provisional Application No. 60/476,887 filed Jun. 5, 2003.

BACKGROUND

This invention relates generally to central vacuum cleaning systems, and more particularly to central vacuum cleaning systems comprising retractable suction hoses that retract into a system vacuum pipe.

Central vacuum cleaning systems are well known and have been available for many years. One early design is U.S. Pat. No. 3,593,363 issued in 1972 disclosing a central vacuum cleaning system using a retractable hose. The inserted end of the hose has a compressible annular seal. The hose is pulled out of the suction conduit located in a wall or floor until the foot end or inserted end reaches the receptacle mounted on the floor or wall, at which time the annular seal on the hose engages a corresponding annular abutment at the receptacle to hold the hose in position and seal between the hose and the receptacle. Accordingly, this design requires that the full length of the hose be pulled out prior to the user using the vacuum.

In 1987, U.S. Pat. No. 4,688,596 issued disclosing a wall outlet box for a control vacuum system that connects to a vacuum hose. The '596 design does not provide any hose storage, or retractable hose features.

In 1990, U.S. Pat. No. 4,895,528 issued disclosing a hose-to-wall fitting for a central vacuum system. Like the earlier '596 reference, the features of the '528 patent were directed to a hose connection fitting only.

Later, in 1996, U.S. Pat. No. 5,526,842 issued to Christensen disclosing a motorized hose wind-up mechanism that requires a somewhat complicated and expensive mechanism for the operation thereof.

While most of the above noted central vacuum system designs include features that are useful in the task to perform the debris vacuum removal process, they typically do not provide a simple, quick way of deploying a long vacuum hose to a selected length. In addition, these designs do not address the problems associated with convenient storage of such long hoses.

Accordingly, a need remains for a central vacuum cleaning system that is easy to install, and facilitates ease of deployment of the vacuum hose therein, and ease of storage of the same following the use of a long vacuum hose to quickly clean large areas.

SUMMARY OF THE INVENTION

One object of the present invention is to reduce the effort required to deploy and operate a central vacuum system.

A second object is to reduce the costs associated with installing a central vacuum system.

Another object is to manage and easily store a long vacuum hose in a central vacuum system.

Yet another object is to employ common readily available vacuum accessories constructed for use with central vacuum systems.

A further object is to stabilize and maintain a deployed vacuum hose that moves responsive to the vacuum created by a central vacuum system.

Still another object is to maintain the air seal around a vacuum hose designed to retract in a vacuum system pipe.

An additional object is to allow the user to select the desired length of vacuum hose needed to perform the vacuum process.

The invention is a retractable hose central vacuum cleaning system provided for use in locations where ease of deployment of the vacuum hose is desired. The retractable hose central vacuum cleaning system comprises a retractable vacuum hose that includes a tool end adapted to removably receive a vacuum cleaning tool for vacuuming debris, and an opposing retracting end.

In addition, the retractable hose central vacuum cleaning system includes a valve assembly having a receiving port for receiving the retracting end of the vacuum hose. In this way, the vacuum hose can extend through the receiving port and through the valve assembly. Further, the valve assembly comprises a vacuum pipe connection port that is adapted to receive a system vacuum pipe that is in communication with a centrally located vacuum source for creating a vacuum within the system vacuum pipe.

Moreover, the valve assembly incorporates a static valve seal that is located between the receiving port and the vacuum pipe connection port. The static valve seal is adapted for coupling together a system vacuum pipe to the vacuum hose to create a substantially air-tight sealed communication between the system vacuum pipe and the vacuum hose. Accordingly, the vacuum generated by a central vacuum source is communicated through a system vacuum pipe, and through the vacuum hose to a vacuum cleaning tool.

In order to manage the vacuum hose, the static valve seal is adjustable from a first unsealed configuration where the vacuum hose can move freely, in either direction, through the valve assembly and through a system vacuum pipe. As will be more fully explained in the following, the retracting movement of the vacuum hose is responsive to the vacuum created by a vacuum source.

Further, the static valve seal is adjustable to a second sealed configuration where the vacuum hose is in sealed communication with a system vacuum pipe, and where the vacuum hose is substantially fixed in relative position to the valve assembly. In this way, the movement from first configuration to the second configuration enables a user to select and fix the vacuum hose length that extends outward from the receiving port of the valve assembly.

The foregoing and other objects, features, and advantages of this invention will become more readily apparent from the following detailed description of a preferred embodiment which proceeds with reference to the accompanying drawings, wherein the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention.

BRIEF DESCRIPTION OF THE DRAWINGS

FIG. 9 is a fragmentary perspective view of a hose collar installed on an end of a vacuum hose with a hose sock tucked around the end of the vacuum hose, and the hose collar engaging the vacuum hose and hose sock to maintain the hose sock in position.

FIG. 10 is a fragmentary sectional view illustrating an o-ring retainer employing an o-ring to maintain an air-tight connection between a system vacuum pipe and the valve assembly.

DETAILED DESCRIPTION OF PREFERRED EMBODIMENT

Figures 1, 1A:
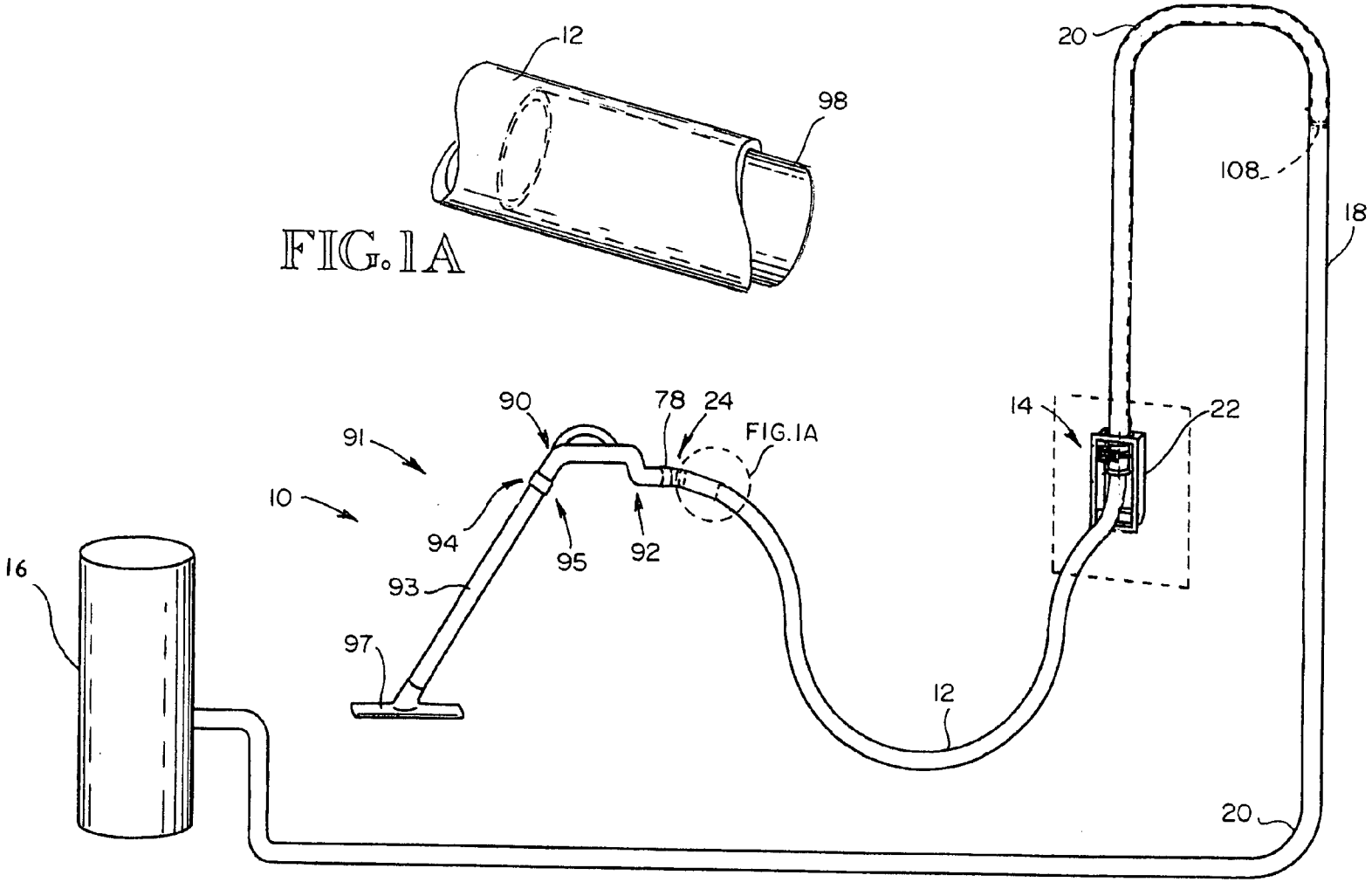
FIG. 1 is a simplified schematic view illustrating a retractable hose central vacuum system connected to a vacuum system pipe that includes a central vacuum source.
FIG. 1A is a fragmentary side perspective view illustrating an end cuff stiffener inserted into a vacuum hose near the hose end cuff thereof.

FIGS. 1 through 9 show an embodiment of a retractable-hose central vacuum cleaning system 10. The vacuum cleaning system 10 is provided to assist and simplify the management of a retractable vacuum hose 12 in locations where ease of deployment of a vacuum hose is desired.

The vacuum cleaning system 10 comprises the retractable vacuum hose 12 of the type commonly employed in central vacuum cleaning systems, and a valve assembly 14 designed to operate with a standard, readily available central vacuum source 16. A plurality of valve assemblies such as valve assembly 14 may be installed in the vacuum cleaning system 10, and may be positioned at various locations in a building. The vacuum cleaning system 10 also utilizes industry standard vacuum plumbing, including a system vacuum pipe 18, with minor exceptions. Large radius elbows 20, having a radius in the range of 9 to 12 inches, are required to allow the vacuum hose 12 to pass through the bends in the system vacuum pipe 18. Likewise, as will be discussed more fully below, a valve housing 22 is typically provided to contain the hose-clamping and sealing components of the valve assembly 14, as well as for accessing the tool end 24 of the vacuum hose 12.

Figure 2:
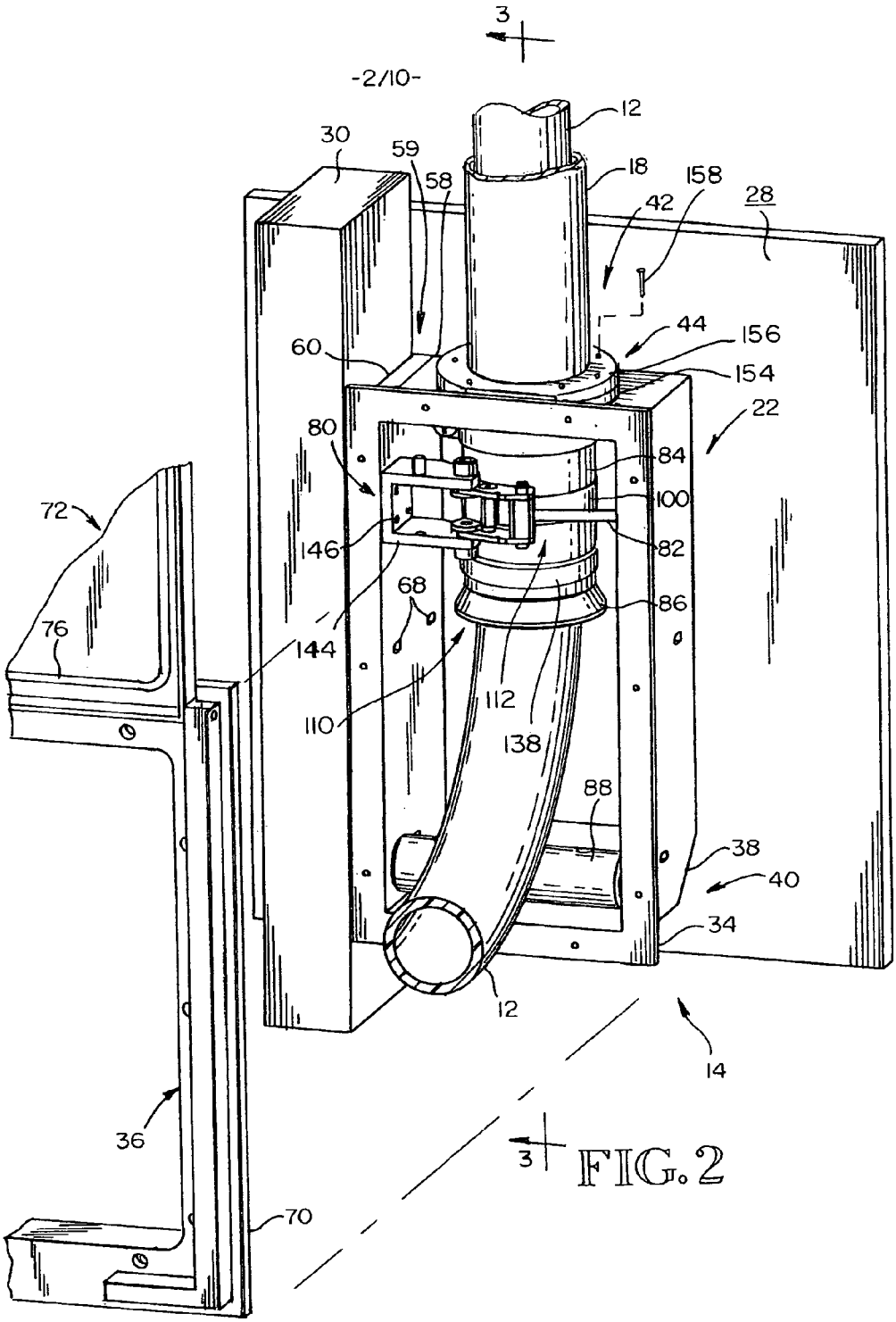
FIG. 2 is a front side perspective view of a valve assembly having a vacuum hose extending through the same, wherein the valve housing thereof is installed within a wall structure with the system vacuum pipe routed from above.
Figure 3:
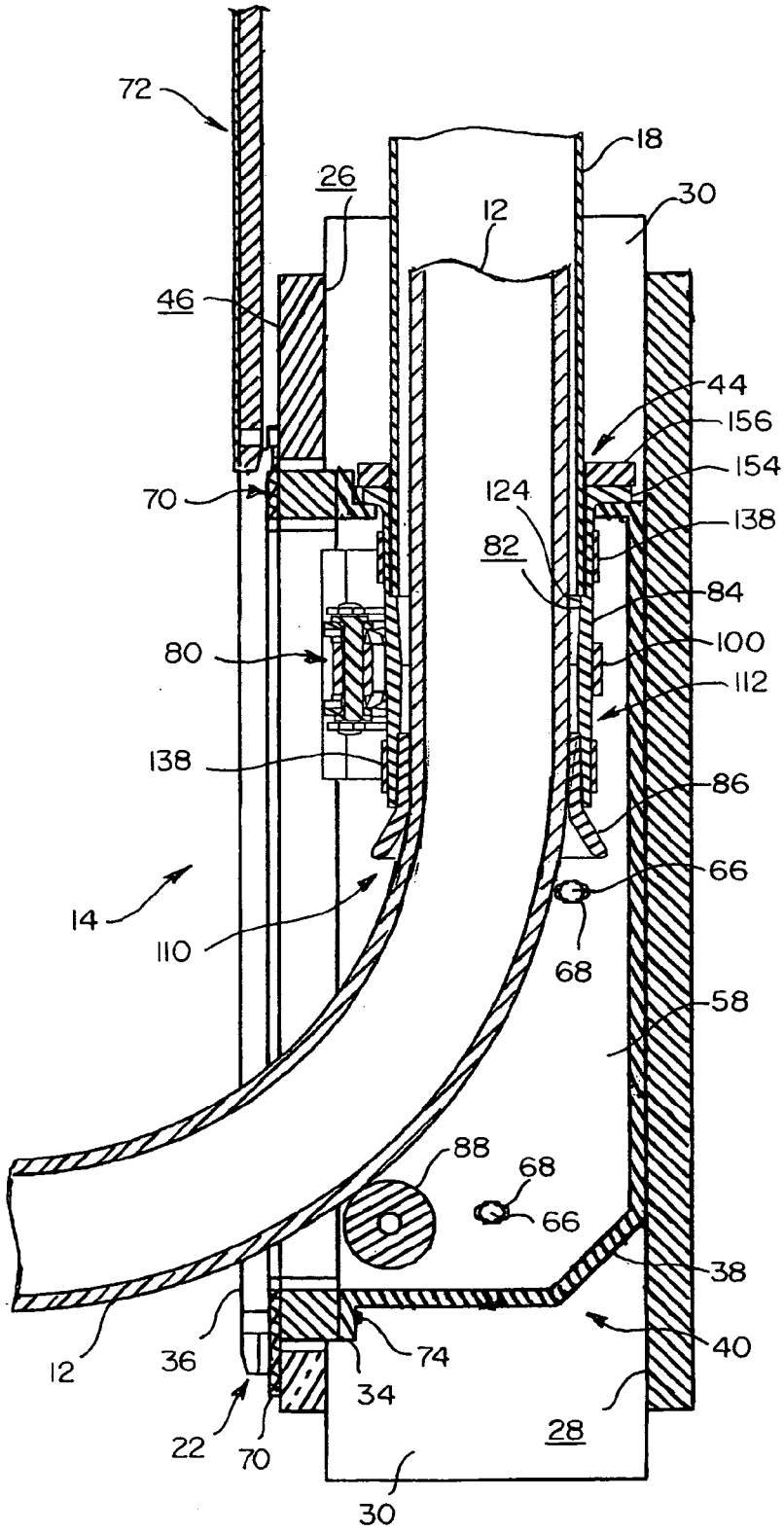
FIG. 3 is a cross-sectional view taken along 3—3 in FIG. 2. illustrating the valve assembly and the valve housing thereof installed within a wall structure.

Valve assembly 14 is connected for communication with a suitable system vacuum pipe 18 fitted with large radius elbows to facilitate hose storage within the system vacuum pipe 18. Additionally, the valve assembly 14 is preferably formed with the suitable valve housing 22 that can be installed within a standard wall construction between wall surfaces 26 and 28, and secured to wall stud 30 as is shown in FIGS. 1 through 3. As illustrated, the valve assembly 14 is configured for ease of removal from its mounted position to facilitate servicing and replacement without altering the wall covering or the vacuum system plumbing. The valve assembly 14 is designed to fit completely into the space inside a standard 2×4 stud wall, between wall surfaces 26 and 28, through an opening in the wall that is larger, by a clearance gap, than the foot print of the valve housing face flange 34. In this way, a faceplate 36 that mounts flush with the wall outside surface 46 is used to cover the clearance gap.

The back edge 38 of the valve housing 22 is chamfered for installation clearance as shown in FIG. 3. The chamfered end 40 of the valve housing 22 is inserted into the wall so that the same is disposed away from the vacuum pipe end 42 and rotated through the opening until it is totally inserted between the wall surfaces 26 and 28. The valve assembly 14 is then slid towards the vacuum pipe end 42 until the vacuum pipe connection port 44 engages the vacuum pipe end 42 of the system vacuum pipe 18. For installation, valve housing 22 is gently rocked back and forth to aid in the alignment and insertion of the vacuum pipe end 42 into the vacuum pipe connection port 44.

In one embodiment illustrated in FIG 10, an o-ring retainer 50 has a lead-in taper, i.e., a radially tapered inner surface 52 to accommodate an angular misalignment with the centerline of the system vacuum pipe 18. With this arrangement, as the vacuum pipe end 42 enters the o-ring retainer 50, it slides through and against a captive o-ring 56 which seals the outside surface of the system vacuum pipe 18 with the lead-in radially tapered inner surface 52. No other attachments to the system vacuum pipe 18 are required. The o-ring retainer 50 has clearance ahead of the o-ring 56 to accommodate variation in vacuum pipe engagement lengths. Since sealing occurs on the radially outer surface of the system vacuum pipe 18, the condition and exact position of the vacuum pipe end 42 is not critical.

Turning now to FIGS. 2 and 3, valve housing face flange 34 is disposed adjacent to, and flush with the wall stud 30 which results in a gap 59 between the sidewall 58 of valve housing 22 and wall stud 30. Accordingly, a wall stud standoff 60 is attached to wall stud 30 to build or shim out-to the sidewall 58 of valve housing 22. In addition, the valve housing 22 is attached to the wall stud 30 and wall stud standoff 60 with mounting screws 66 through horizontal slots or holes 68 in the valve housing sidewall 58. The valve assembly 14 is then slid towards the wall opening to the limit of the mounting slots, i.e., holes 68 and the mounting screws 66 lightly tightened. A standoff 70 the same general size and shape as the valve housing face flange 34 is used to build out slightly beyond the wall 18 outer surface. The faceplate 36 and valve housing door 72 are then attached to the valve housing 22 by passing mounting screws 74 through the standoff 70 into the valve housing face flange 34. As indicated in the drawings, the standoff 70 can be constructed integrally with the faceplate 36.

To facilitate mounting the valve housing 22, the hex head mounting screws 66, inside the valve housing 22 are loosened and the whole valve assembly 14 slid back into the wall until the faceplate 36 rests flush against the outer wall surface. The mounting screws 66 are then tightened.

In some installations the system vacuum pipe is routed down through the wall from the ceiling and in others it is routed up from the floor. The valve assembly 14 can be mounted with the vacuum pipe connection port 44 pointing up or down and on either side of the wall stud 30.

The common mounting hole pattern in the faceplate 36, standoff 70 and valve housing face flange 34 is typically symmetrical. The faceplate 36 and valve housing door 72 are mounted with the valve housing door swinging up. The valve housing 22 can be mounted with the vacuum pipe connection port 44 pointing up or it can be rotated 180 degrees and mounted with the same pointing down. In either case the valve housing door 72 swings up. The valve housing door is equipped with a seal 76 and when closed, the valve housing 22 is air tight preventing leakage and reduced vacuum suction at the other valves in the system.

For system operation, the vacuum hose 12 is extracted from storage by opening valve housing door 72 on the valve assembly 14, reaching inside, grasping the hose end cuff 78 and pulling outward. Any length of vacuum hose 12, up to full length, can be extracted. The operator then closes clamp 80 by moving the clamp lever 82 to the second closed-clamping position. This seals the outer surface of the vacuum hose 12 to the radially inner surface 83 of a flexible sleeve 84 which is connected through the vacuum pipe connection port 44 to the system vacuum pipe 18 preventing air leaks. It also locks the vacuum hose 12 in position preventing further deployment or retraction.

Moreover, there is a hose receptacle 86 and a guide roller 88 to guide the vacuum hose 12 and prevent chafing as it enters and leaves the valve assembly 14. The operator now attaches the tool handle 90 onto the vacuum hose end cuff 78. It should be noted the tool handle 90 is one of various vacuum accessories 91 which could also include a vacuum wand 93, and a vacuum cleaning tool 97 as illustrated in FIG. 1. The vacuum cleaning system 10 is now ready to use in the conventional manner. This system may feature a wireless (RF) controller (not illustrated) integrated into the tool handle 90 to turn the vacuum source 12 on and off. An off-on switch (not illustrated) could be mounted on or near the valve assembly 14 if the wireless controller is not preferred.

Use of a wireless controller eliminates the need for any electrical wiring routed to the valve assembly 14 and any electrical conductors in the vacuum hose 12. This results in a cost savings both in installation labor and in the use of lower cost components.

Conventionally, vacuum cleaning systems are provided with a debris trap for preventing large debris, such as pens and pencils, from entering the system. Typically this trap is in the form of a sharp 90 degree turn in the system vacuum pipe immediately behind the valve assembly. As previously noted, this hose storage system cannot tolerate sharp turns in the portion of the pipe used for hose storage, so a debris trap can not be use at this location. A much preferred location for the debris trap 92 is shown in FIG. 1, wherein debris trap 92 is integrated into the tool handle 90 in the form of an offset or jog in the air passage.

Alternately, the debris trap can be located anywhere between the tool end 24 of vacuum hose 12 and the tool end 95 of the tool handle 90. It can be integrated into the tool handle 90 or it can be a separate component. In addition, it should also be noted that an end cuff stiffener 98 can also be employed as a stiffening insert within the vacuum hose 12 near the hose end cuff 78, or at the opposing retracting end 108. The cuff stiffener is primarily used to prevent the vacuum hose 12 from bending enough to travel or move through the valve assembly 14.

When the operator is finished with the cleaning task, the vacuum hose 12 is retracted by releasing the clamp 80, and allowing the system vacuum to pull the vacuum hose 12 back to the valve housing 22 and into the system vacuum pipe 18. The rate of retraction can be controlled by restricting the air flow into the tool handle nozzle 94 or hose end cuff 78 with the operator's hand or other air restriction device.

The tool handle 90 is then detached from the hose end cuff 78 and the vacuum hose 12 is retracted inside and through the valve assembly 14. If so equipped, the RF sender (not illustrated) on the tool handle 90 is used to turn off the vacuum source 16 and the valve housing door 72 is closed. The tool handle 90 and other vacuum accessories used are stored in a conventional closet or cabinet.

Directing attention to FIG. 9, the performance of this hose storage and retraction arrangement can be enhanced by covering vacuum hose 12 with a thin, tight fitting fabric hose sock 96. Most vacuum hoses are of the elastomeric spiral ribbed construction and generate significant friction between the hose outer surface thereof and the vacuum plumbing including the system vacuum pipe 18. Further, a fabric tube, referred to in the industry as a "hose sock" is placed over the entire length of the vacuum hose 12. This reduces the friction and provides increased "sealing action" between the outside surface of the hose sock 96 and the radially inner surface of the system vacuum pipe 18 thereby increasing the suction force available to pull the hose back into the system vacuum pipe 18 using the system vacuum suction.

The hose sock 96 does not provide an air tight seal with the system vacuum pipe 18. This leakage reduces the suction and air flow available for cleaning at the "tool end" of the vacuum hose 12 and must be eliminated during the vacuuming operation.

Accordingly, it is the valve assembly 14 that comprises a primary object of this invention. Included therein is a flexible sleeve 84 disposed in the valve housing 22 connected to the system vacuum pipe through the vacuum pipe connection port 44. The vacuum hose 12 passes through the flexible sleeve 84 before exiting the valve assembly 14. The flexible sleeve 84 is encircled by a clamp band 100 which can be tightened or loosened by the operator moving the clamp lever 82 which opens and closes clamp 80. The clamp band 100 correspondingly compresses, i.e., radially deforms, or relaxes the flexible sleeve 84 radially. When the flexible sleeve 84 is deformed, i.e., compressed radially around the radially outer surface 101 (FIG. 9) of the vacuum hose 12, and accordingly the hose sock 96, it forms a seal forcing the air to flow into the tool end 24 of the vacuum hose 12.

It should be understood that when the flexible sleeve 84 is compressed as noted above, it also provides another important function. For example, any time the system vacuum source 16 is turned on, the suction pulls the vacuum hose 12 back into the system vacuum pipe 18. The pulling force varies depending on the degree of air restriction at the tool end 24 of the vacuum hose 12. This means that unless the vacuum hose 12 is axially restrained by some other means, the operator would constantly have to pull on the vacuum hose to keep it from being retracted into the system vacuum pipe 18. The radially compressed and deformed sleeve 84 acts as a brake or lock to axially restrain the vacuum hose 12.

Turning again to FIG. 9, there is a recognized need in the central vacuum cleaner industry for a convenient, low profile device to secure and terminate the ends of hose socks to the vacuum hose ends. One present industry method of attachment utilizes draw strings (not illustrated), captured in the ends of the sock, which are pulled tight around the vacuum hose and tied. This results in an enlarged sock outside diameter, and a draw string knot at each end of the sock. For this reason, the present invention includes a hose collar 104 which provides an improved method of attaching the hose sock 96 to the vacuum hose 12 at the ends thereof. Hose collar 104 has an outer surface 106 which engage the internal threads or spiral ribs on a vacuum hose inner surface 102. Accordingly, the hose sock 96 covers the entire outer surface of vacuum hose 12.

In installation, the hose collar 104 is forced into the vacuum hose 12, pressing the hose sock 96 against the inner wall of the vacuum hose 12, trapping hose sock 96 between the hose collar 104 and the vacuum hose 12. While this design and arrangement utilizes a hose collar 104, any device with features that engage the inner surface 102 of a vacuum hose 12, and that engage and trap the hose sock 96 between these features and the inner surface 102 of a vacuum hose 12 could be employed.

Additionally, the hose collar 104 includes an outer surface 106 that is the same or slightly larger than the inside diameter of the vacuum hose 12. Similarly, the outside diameter 107 of the hose collar 104 is also slightly larger than the inside diameter of the radially inner surface 83 of the flexible sleeve 84 when the same is in the unclamped position. Accordingly, the hose collar 104 acts as a stop or detent when the vacuum hose 12 is fully extended. This prevents the hose end from inadvertently being pulled out of the hose receptacle 86 during a deployment.

For removal, the hose end at hose collar 104 can be removed from the hose receptacle 86 and valve housing 22 by grasping the vacuum hose 12, as it enters the hose receptacle 86, and gently pulling straight down. The flexible sleeve 84 will expand, functioning as a detent, and allow the hose collar 104 to pass through.

This procedure can also be used to remove the vacuum hose 12 from the wall for service, cleaning or replacement. The vacuum hose 12 can also be easily moved from one valve assembly to another, and stored at the last valve assembly used.

While the present vacuum hose storage arrangement focuses on convenient management of multiple hoses, this feature allows the system to be operated with only one hose and yet provides for convenient hose storage at the last location used. This feature also allows a vacuum hose 12 to be shared by another valve assembly which has a damaged vacuum hose until a replacement is obtained.

Another feature of the present invention, is that clamp lever 82 is located such that when the clamp 80 is closed, the position of the clamp lever 82 prevents the valve housing door 72 from being closed. In other words the clamp 80 must be in the first unlocked position in order to close the valve housing door 72. This prevents the flexible sleeve 84 from being left in the "compressed" deformed condition for long periods of time. When clamp 80 is open, clamp lever 82 is inside the valve housing 22 thereby allowing the valve housing door 72 to close and seal.

A plurality of valve assemblies such as valve assembly 14 can be positioned in vertical walls or in horizontal floor configurations, wherein each would employ its own hose 12, and each would be installed and connected to a common central vacuum cleaning system 10.

In another aspect of the invention, the vacuum hose 12 includes a retracting end 108 that leads the vacuum hose 12 into and through the valve assembly 14. For this purpose, valve assembly 14 includes a receiving port 110 which is defined by hose receptacle 86 for receiving the retracting end 108 of the vacuum hose 12. In this way, the vacuum hose 12 can extend through the receiving port 110, and through the valve assembly 14. Further, as noted above, the valve assembly 14 comprises the vacuum pipe connection port 44 adapted to receive the system vacuum pipe 18 that is in communication with a centrally located central vacuum source 16 for creating a vacuum within the system vacuum pipe.

Importantly, the valve assembly 14 incorporates a static valve seal 112 that is located between the receiving port 110 and the vacuum pipe connection port 44. In general The static valve seal 112 comprises the components that facilitate the substantially air-tight seal between the vacuum hose 12 and the system vacuum pipe 18.

Regarding the above disclosure, the static valve seal 112 would include the flexible sleeve 84 and clamping components including clamp 80 along with its clamp lever 82 and clamp band 100. In the present invention, the flexible sleeve 84 includes an integrally formed sleeve flange 154 that is disposed adjacent the valve housing 22 as illustrated in FIG. 2. Additionally, a flange retainer 156 is included to securely connect and lead-in the system vacuum pipe 18 into the flexible sleeve 84. Fasteners such as 158 could be employed to secure the flange retainer 156.

Moreover, the static valve seal 112 is adapted for coupling together a system vacuum pipe 18 to the vacuum hose 12 to create a substantially air-tight sealed communication between the system vacuum pipe 18 and the vacuum hose 12. With this construction, the vacuum generated by the central vacuum source 16 is communicated through the system vacuum pipe 18, and through the vacuum hose 12 to the vacuum accessories 91 including a vacuum cleaning tool 97 which could be connected to a vacuum wand 93.

In order to manage the vacuum hose 12, the static valve seal 112 is adjustable from a first unsealed configuration where the vacuum hose 12 can move freely, in either direction, through the valve assembly 14 and through a system vacuum pipe 18. As disclosed above, the retracting movement of the vacuum hose is responsive to the vacuum or suction created by a vacuum source 16.

Further, the static valve seal 112 is adjustable to a second sealed configuration where the vacuum hose is in sealed communication with a system vacuum pipe 18, and where the vacuum hose 12 is substantially fixed in relative position to the valve assembly 14. In this way, the movement from first configuration to the second configuration enables a user to select and fix the length of vacuum hose 12 that extends outward from the receiving port 110 of the valve assembly 14.

In one embodiment, the static valve seal 112 comprises radially deformable flexible sleeve 84 adapted for sealed communication with the system vacuum pipe 18. The flexible sleeve 84 is disposed for receiving the vacuum hose 12 so that the vacuum hose 12 can extend substantially coaxially through the flexible sleeve 84, into the system vacuum pipe 18. Importantly, the flexible sleeve 84 is adjustable to radially deform from a first non-deformed configuration, where the vacuum hose 12 can move substantially freely through the valve assembly 14 and into the system vacuum pipe 18, to a second radially deformed configuration where the flexible sleeve 84 is radially deformed to constrict tightly around the vacuum hose 12 to create substantially air-tight sealed communication between the vacuum hose 12 and a system vacuum pipe 18.

It should be understood, that there are many ways to cause the flexible seal 84 to deform as noted above. For example, a user could simply grasp the flexible seal with a hand and squeeze tightly. Because the flexible seal 84 is constructed from a somewhat soft PVC type of material, the squeezing pressure would not have to be that great.

Further, the flexible sleeve 84 includes a radially inner sleeve outlet surface 118 that is of a size and diameter to snugly receive the vacuum pipe end 42 of a system vacuum pipe 18. This produces a somewhat loose interference fit that could be adequate to form an air-tight seal between the system vacuum pipe 18 and the flexible sleeve 84. However, a clamp mechanism is typically provided to increase and secure the seal. For this purpose, a worm type drive clamp 138 is employed for this purpose.

Figure 4:
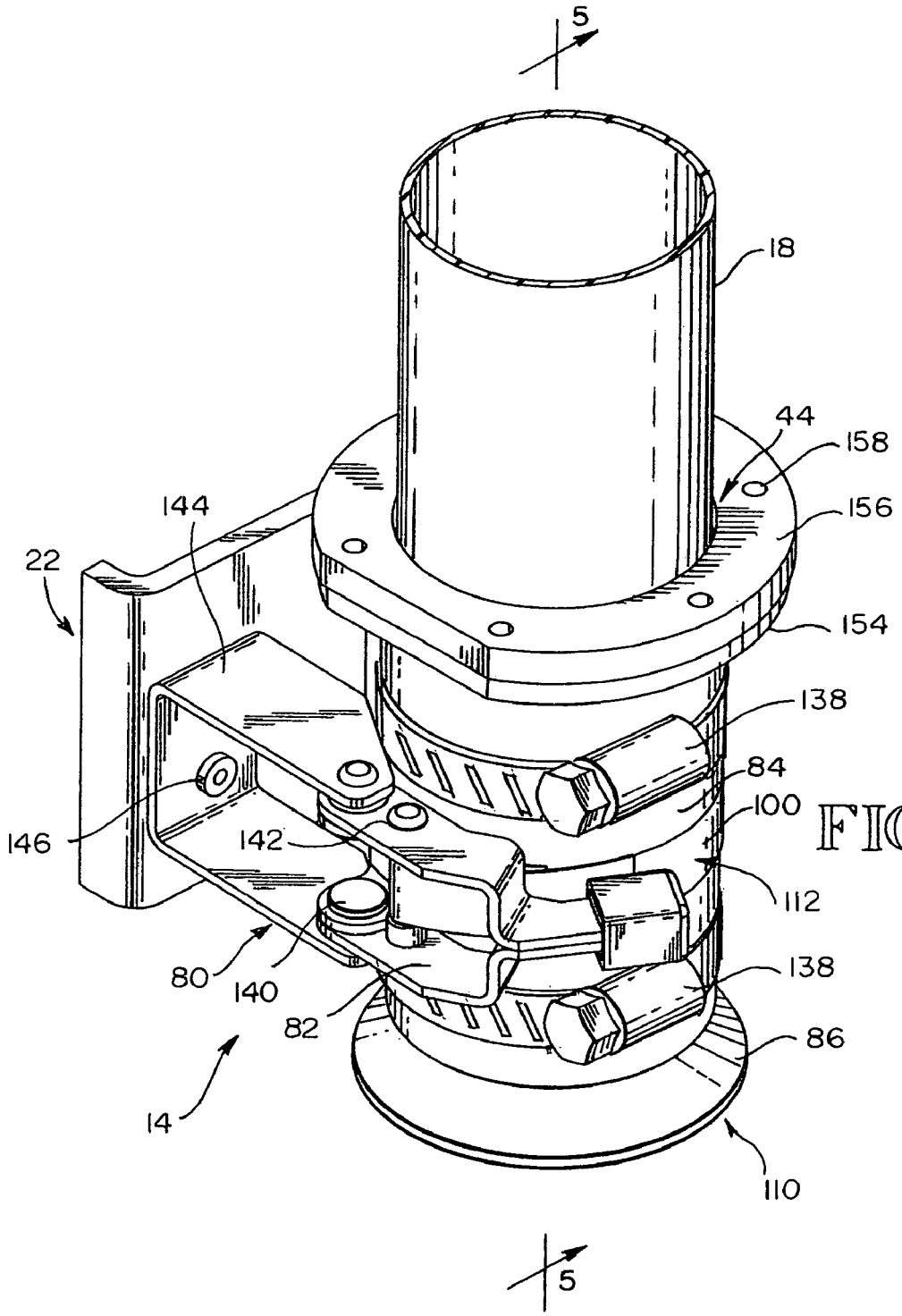
FIG. 4 is a perspective view of a static valve seal wherein the clamp lever is in a first position where the flexible sleeve is in the first undeformed, unsealed configuration, ready to receive a vacuum hose to enable the vacuum hose to move substantially freely through the valve assembly.

Regarding the air-tight seal required between the vacuum hose 12 and the flexible seal 84, one embodiment, noted above, employs the clamp 80 that comprises the clamp band 100 disposed around the flexible seal 84 to deform the same when the clamp lever 82 is moved from an open to the closed clamping position. As can be seen, this type of clamping mechanism simply uses the clamp lever 82 connected to the clamp band 100, wherein the clamp lever pivots about a clamp pivot point 140, with the band connection point 142 shifting to an over-center position in relation to the clamp pivot point 140. In this way, the clamp lever 82 will remain in the closed position when it is so moved. Also, in this type of construction, the clamp 80 could be mounted by a clamp bracket 144 to the valve housing 22 by any means of attachment, including bracket fasteners 146 (FIG. 4)

Figure 11:
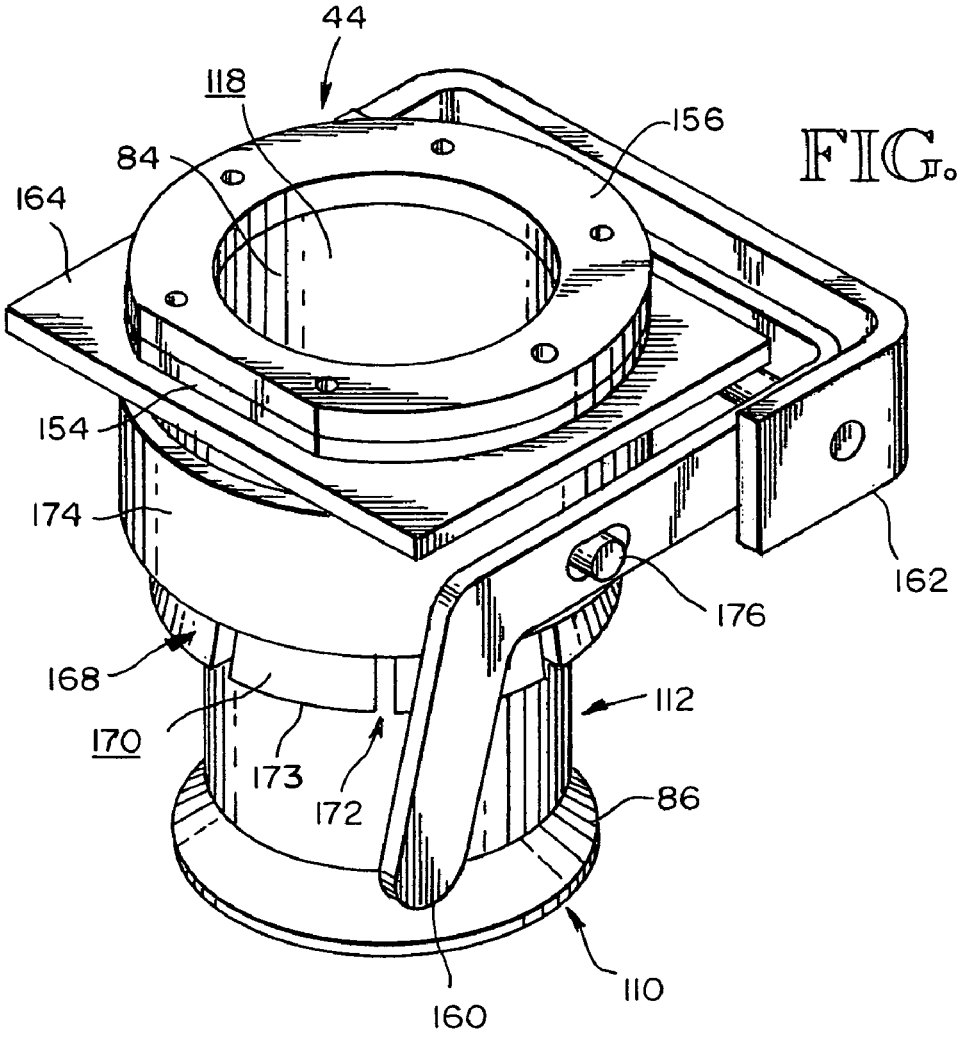
FIG. 11 is a perspective view of an alternate embodiment where a static valve seal comprises a collet shiftingly disposed around a tapered compression sleeve.
Figure 12:
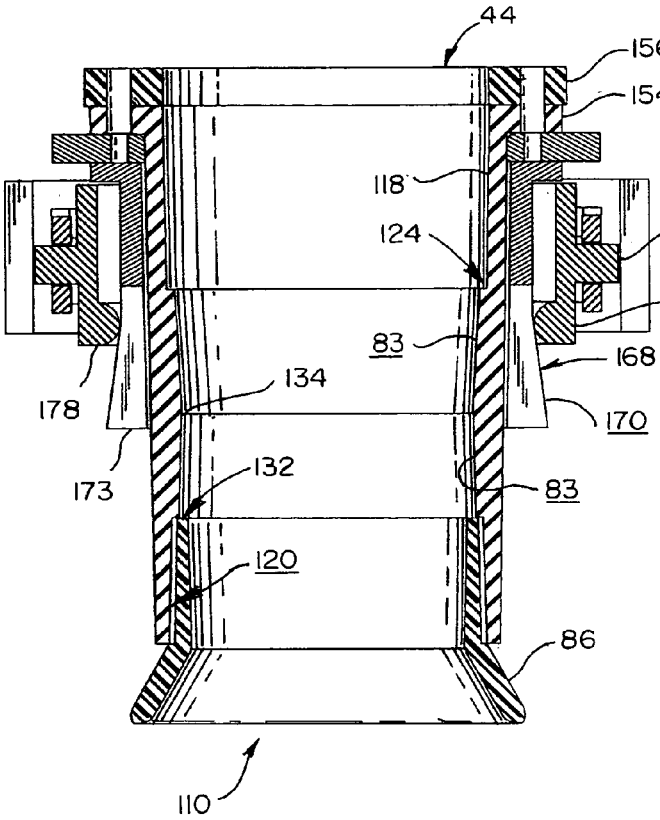
FIG. 12 is a sectional view of the embodiment illustrated in FIG. 11, wherein the radially inner surface of the collet is disengaged from the compression elements of the compression sleeve.
Figure 13:
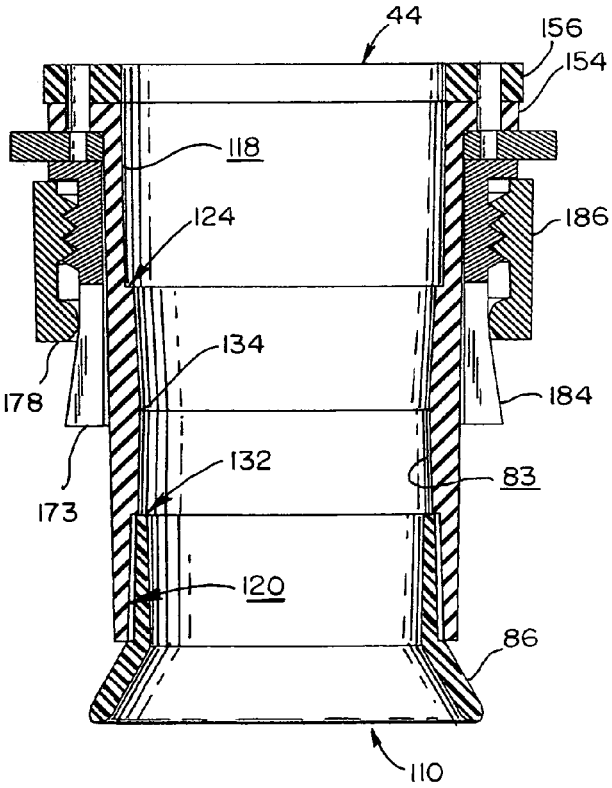
FIG. 13 is a sectional view of an embodiment similar to that of FIG. 12 wherein the collet comprises a radially inner threaded surface for rotational engagement with a threaded compression sleeve, wherein the radially inner surface of the collet is disengaged from the compression elements of the compression sleeve.

Directing attention to FIGS. 11 through 13, another embodiment is illustrated where the static valve seal 112 is formed by a radially tapered member engaging a radially disposed surface. For example, a compression sleeve 168 is coaxially disposed around the flexible sleeve 84. The compression sleeve 168 having a plurality of spaced, cantilevered compression elements 173 encircling the flexible sleeve 84. Each compression element 173 extends along the flexible sleeve 84 to define a radially outer tapered surface 170 that tapers in an axial direction as best illustrated in FIG 12. Also, an axially shiftable collet 174 includes a radial inner surface 178 disposed around the compression sleeve 168. The collet 174 being axially shiftable or slidable from a first position, where the radially inner surface 178 thereof is disengaged from the compression elements 173, to a second engaging position where the radially inner surface 178 of the collet 174 engages the radially outer tapered surface 170 of the compression elements 173 causing the same to bend toward the flexible sleeve 84, deforming the flexible sleeve 84 to constrict tightly around the vacuum hose 12 to create substantially airtight sealed communication between the vacuum hose 12 and a system vacuum pipe 18.

In another aspect of the invention, the collet 186 is threaded as illustrated in FIG. 13. Likewise, the compression sleeve 184 is formed to threadedly engage the threaded collet 186 by rotation of the collet 186. As can be seen, the same sealing action in imposed on the flexible seal 84.

Figure 5:
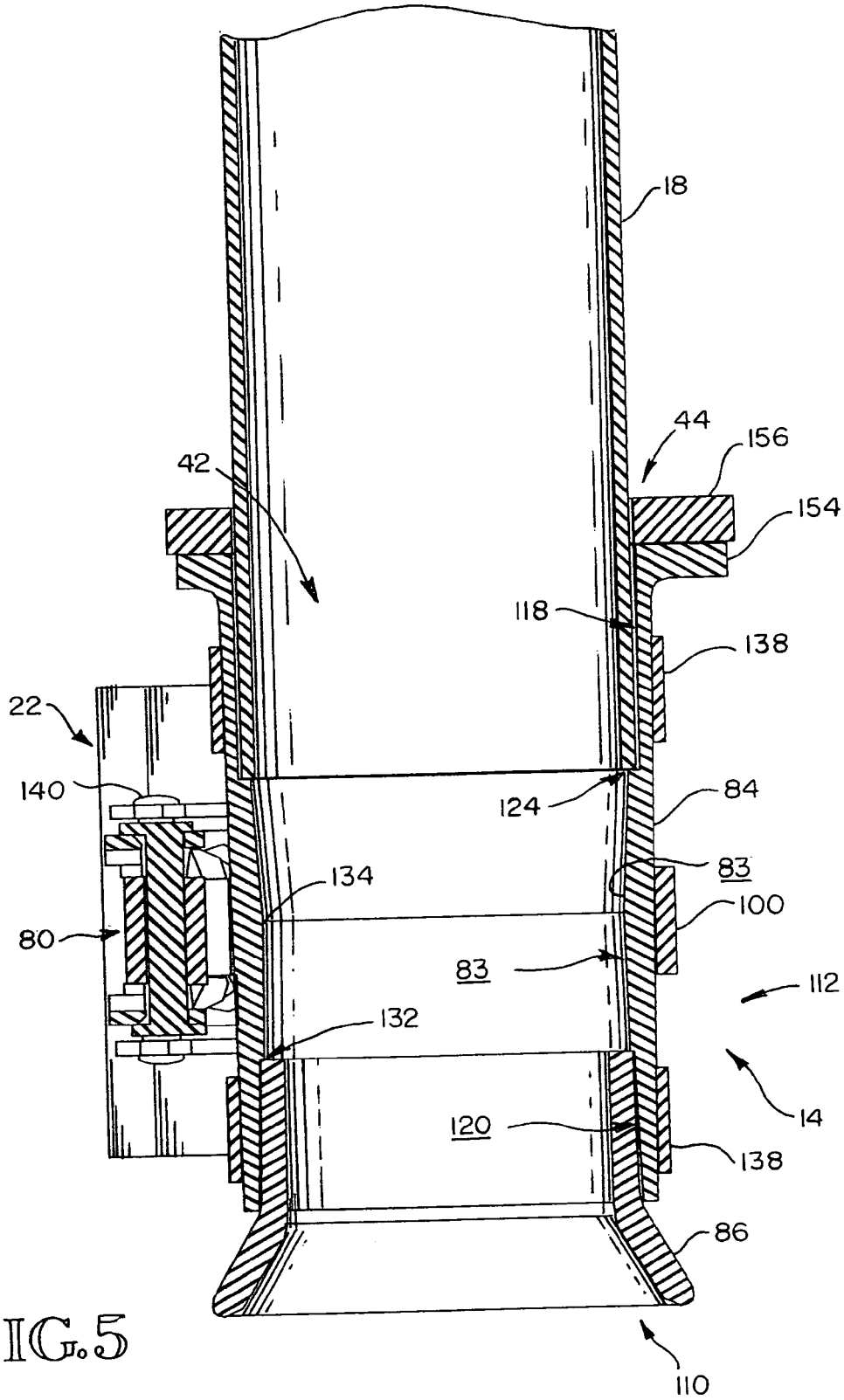
FIG. 5 is cross-sectional view taken along 5—5 in FIG. 4.
Figure 6:
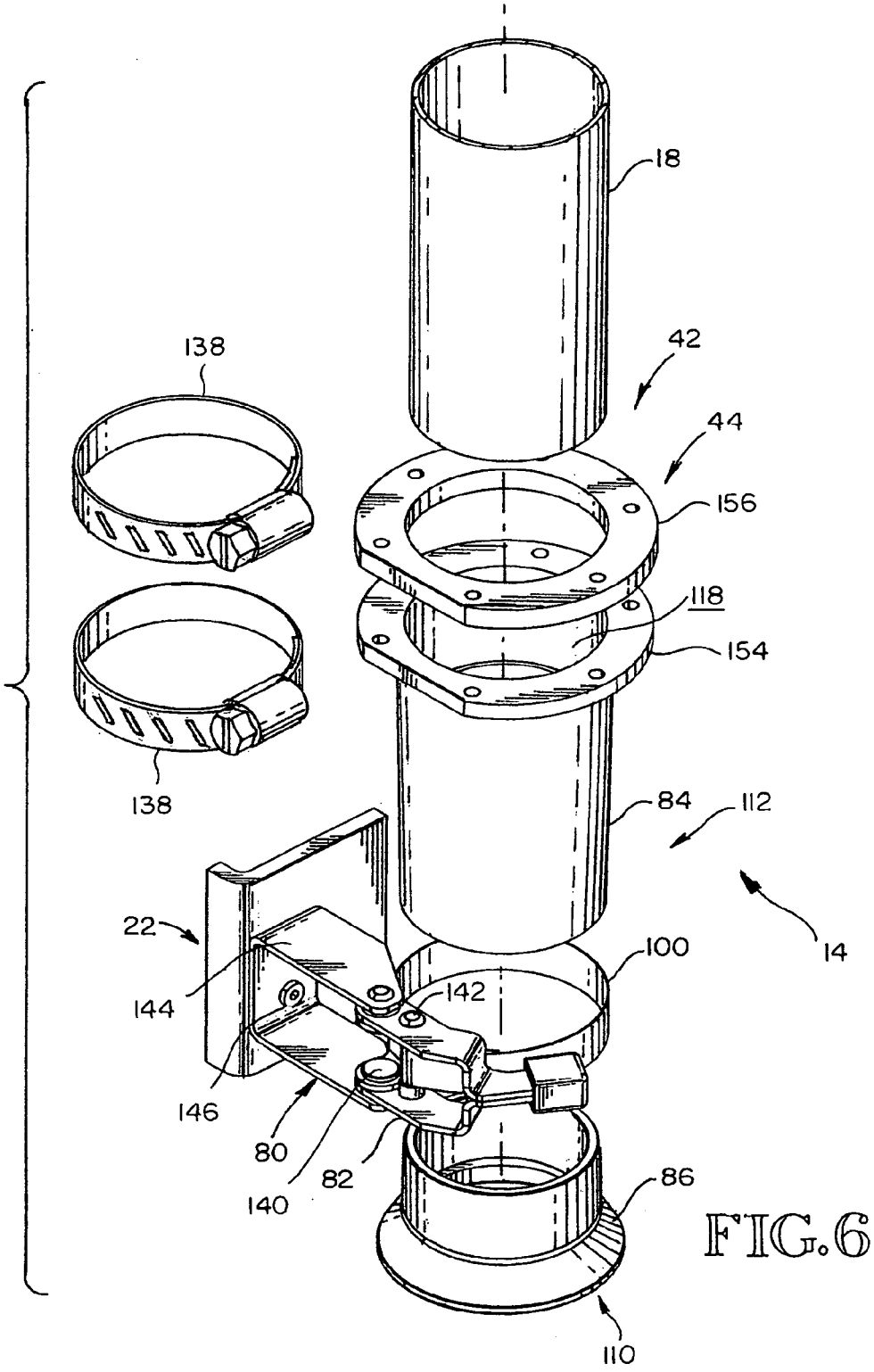
FIG. 6 is an exploded perspective view of a static valve seal and the components thereof.
Figure 7:
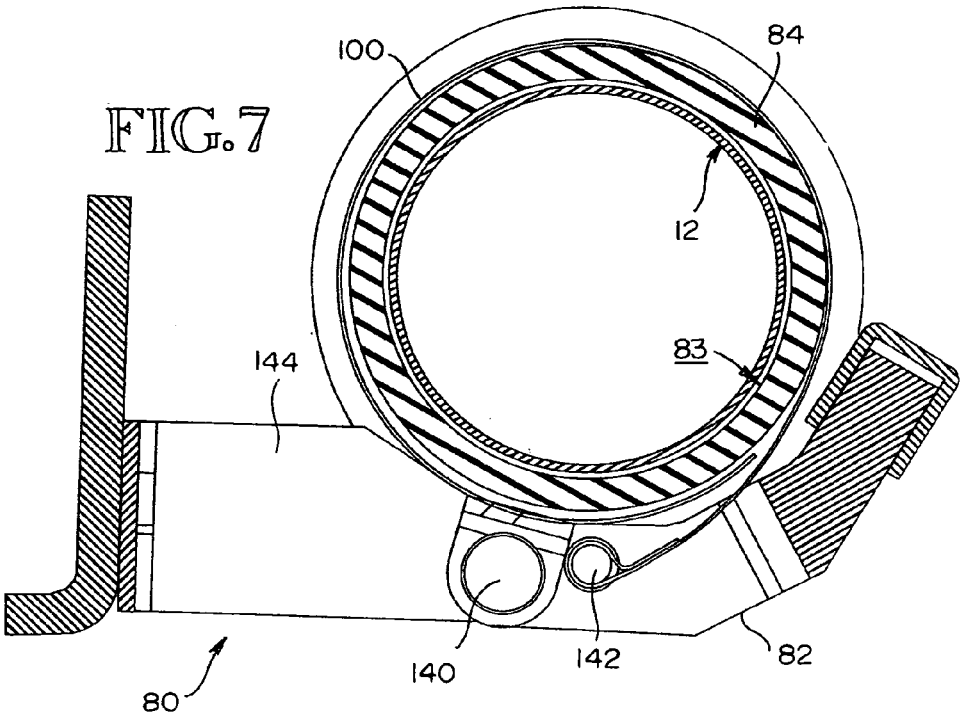
FIG. 7 is a cross-sectional view through the clamp of a static valve seal with the clamp in the first unclamped position.
Figure 8:
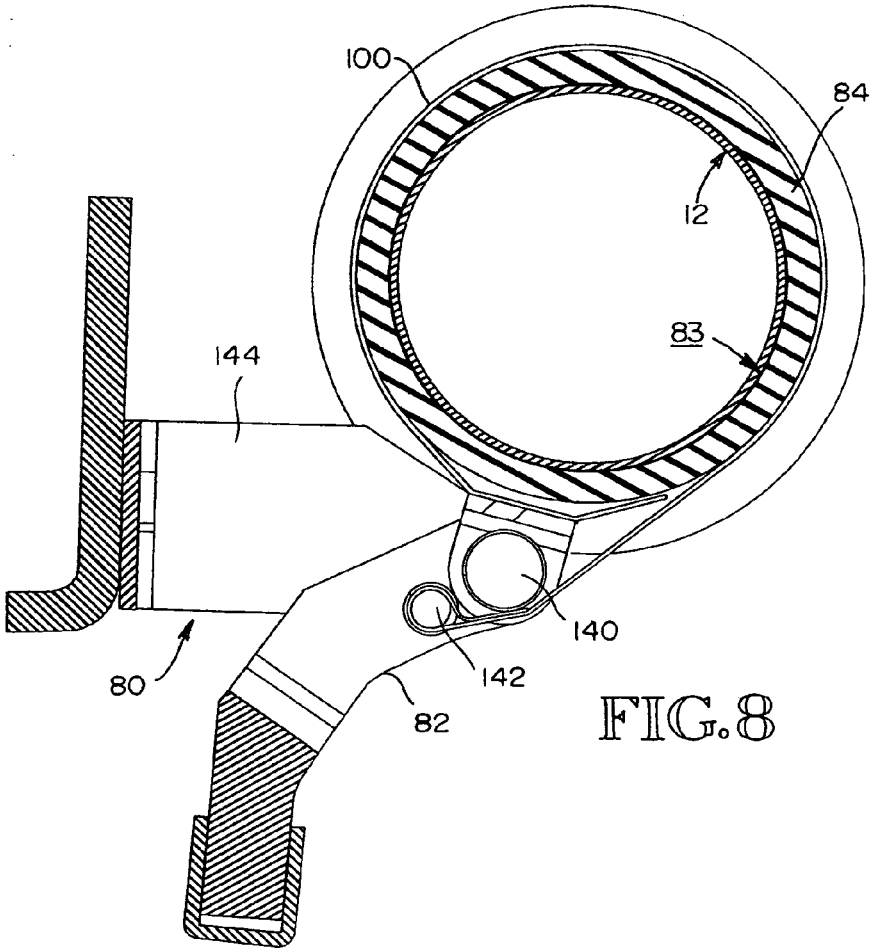
FIG. 8 is a cross-sectional view through the clamp of a static valve seal with the clamp in the second clamping position.

Regarding the fit of the system vacuum pipe into the flexible sleeve 84, a system pipe receiving seat 124 is formed by creating a step in the transition from the radially inner sleeve outlet surface 118 to the sealing portion of the flexible seal 84. Similarly, a receptacle receiving seat 132 is formed by creating a step as best shown in FIGS. 5, 12, and 13. The receiving seat 132 is provided as a stop for the hose receptacle 86. Additionally, because of the manufacturing process, a crown 134, i.e., a slightly raised area, is formed in the radially inner surface 83, of the flexible seal 84.

In the drawings and specifications there have been set forth preferred embodiments of the invention and although specific terms are employed, they are used in a generic and descriptive sense only and not for purposes of limitation. The design of the hose seal and restraint depicted in this invention combine several functions, that of sealing, restraining and wear reduction, into one device or mechanism. Separate devices or mechanisms could be used for each function. Other devices or mechanisms could be used to achieve the functions and results.

In addition, whereas the drawings and specifications relate to central vacuum cleaning systems for a home or building, the application is not limited to this industry alone but to any industry or operation where a vacuum system is used.

Finally, as stated above, this application is based on, and claims benefit of U.S. Provisional Application No. 60/476,887 filed Jun. 5, 2003. It should be noted that the reference numerals for some of the components have been changed from the provisional application. The changes were only made to present a generally more sequential order thereof in the specification, and to aid the reader in locating and cross reference components disclosed in the illustrations and the specification.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

What is claimed is:

1. A retractable hose central vacuum cleaning system comprising:

a retractable vacuum hose having a tool end adapted to removably receive a vacuum cleaning tool for vacuuming debris, and an opposing retracting end;

a valve assembly having a receiving port for receiving the retracting end of the vacuum hose, wherein the vacuum hose is extendable through the receiving port and through the valve assembly;

the valve assembly further comprising:

a vacuum pipe connection port adapted to receive a system vacuum pipe that is in communication with a central vacuum source for creating a vacuum within the system vacuum pipe;

a static valve seal disposed between the receiving port and the vacuum pipe connection port, the static valve seal being adapted for coupling the system vacuum pipe to the vacuum hose to create substantially air-tight sealed communication between the system vacuum pipe and the vacuum hose so that the vacuum generated by the central vacuum source can be communicated through the vacuum hose to the vacuum cleaning tool; and wherein the static valve seal is adjustable from a first unsealed configuration where the vacuum hose can move freely through the valve assembly and through the system vacuum pipe, responsive to the vacuum created by the central vacuum source, to a second sealed configuration where the vacuum hose is in sealed communication with the system vacuum pipe, and where the vacuum hose is substantially fixed in relative position to the valve assembly, wherein the movement from first unsealed configuration to the second sealed configuration enables a user to select and fix the vacuum hose length that extends outward from the receiving port of the valve assembly.

2. The retractable hose central vacuum cleaning system as recited in claim 1 wherein the static valve seal further comprises a radially deformable flexible sleeve adapted for sealed communication with the system vacuum pipe, the flexible sleeve being disposed for receiving the vacuum hose so that the vacuum hose can extend substantially coaxially through the flexible sleeve, into the system vacuum pipe; and wherein the flexible sleeve is adjustable to radially deform from a first non-deformed configuration, where the vacuum hose can move substantially freely through the valve assembly and into the system vacuum pipe, to a second radially deformed configuration where the flexible sleeve is radially deformed to constrict tightly around the vacuum hose to create substantially air-tight sealed communication between the vacuum hose and the system vacuum pipe, and where a selected length of vacuum hose is fixed and maintained outward from the receiving port.

3. The retractable hose central vacuum cleaning system as recited in claim 2 wherein the flexible sleeve further comprises a radially inner sleeve outlet surface adapted to sealingly receive the system vacuum pipe.

4. The retractable hose central vacuum cleaning system as recited in claim 2 wherein the flexible sleeve further comprises a radially inner sleeve outlet surface adapted to sealingly receive the system vacuum pipe, wherein a substantially air-tight seal is formed by an interference fit between the radially inner sleeve outlet surface and the system vacuum pipe.

5. The retractable hose central vacuum cleaning system as recited in claim 3 further comprising an adjustable clamp having a band disposed around the flexible sleeve, the clamp being adjustable to deform the radially inner sleeve outlet surface inward to create a seal between the flexible sleeve and the system vacuum pipe.

6. The retractable hose central vacuum cleaning system as recited in claim 2 wherein the static valve seal further comprises means for radially deforming the flexible sleeve, said deforming means being movable from a first non-deforming configuration where the vacuum hose can move substantially freely through the valve assembly, to a second deformed configuration to deform the flexible sleeve to constrict tightly around the vacuum hose.

7. The retractable hose central vacuum cleaning system as recited in claim 6 wherein the deforming means comprises a clamp having an adjustable clamp band disposed around the flexible sleeve, the clamp band being movable from the first non-deforming configuration, where the vacuum hose can freely move through the valve assembly, to the second radially deformed configuration to radially deform the flexible sleeve to constrict tightly around the vacuum hose to form a substantially air-tight seal between the vacuum hose and the system vacuum pipe.

8. The retractable hose central vacuum cleaning system as recited in claim 7 wherein the clamp further comprises a clamp lever, wherein the clamp band is responsive to the clamp lever being shifted from a first position where the clamp band in untensioned, to a second position where the clamp band is tensioned to radially deform the flexible sleeve to constrict tightly around the vacuum hose.

9. The retractable hose central vacuum cleaning system as recited in claim 2 wherein the static valve seal further comprises:

a compression sleeve coaxially disposed around the flexible sleeve, the compression sleeve having a plurality of spaced, cantilevered compression elements encircling the flexible sleeve, each compression element extending along the flexible sleeve to define a radially outer surface that tapers in an axial direction; and an axially shiftable collet having a radial inner surface disposed around the compression sleeve, the collet being axially shiftable from a first position, where the radially inner surface thereof is disengaged from the compression elements, to a second engaging position where the radially inner surface of the collet engages the tapered surface of the compression elements causing the compression elements to bend toward the flexible sleeve, deforming the flexible sleeve to constrict tightly around the vacuum hose to create substantially air-tight sealed communication between the vacuum hose and the system vacuum pipe.

10. The retractable hose central vacuum cleaning system as recited in claim 9 wherein the collet slidingly engages the compression sleeve.

11. The retractable hose central vacuum cleaning system as recited in claim 9 wherein the compression sleeve further comprises a radially outer threaded portion, and the radially inner surface of the collet comprises a threaded portion to enable threaded engagement with the compression sleeve so that the collet can be rotated to shift from the first position, where the radial inner surface of the collet is disengaged from the compression elements, to the second engaging position where the radially inner surface of the collet engages the tapered surface of the compression elements causing the compression elements to bend toward the flexible sleeve, deforming the flexible sleeve to constrict tightly around the vacuum hose to create substantially air-tight sealed communication between the vacuum hose and the system vacuum pipe.

12. The retractable hose central vacuum cleaning system as recited in claim 2 wherein the valve assembly further comprises a valve housing for enclosing the static valve seal.

13. The retractable hose central vacuum cleaning system as recited in claim 12 wherein the flexible sleeve comprises an integrally formed flange disposed to engage the valve housing.

14. A method for making a retractable hose central vacuum cleaning system comprising the steps:

providing a retractable vacuum hose having a tool end adapted to removably receive a vacuum cleaning tool for vacuuming debris, and an opposing retracting end;

forming a valve assembly having a receiving port for receiving the retracting end of the vacuum hose, wherein the vacuum hose is extendable through the receiving port and through the valve assembly;

wherein forming the valve assembly further comprises the steps:

forming a vacuum pipe connection port adapted to receive a system vacuum pipe that is in communication with a central vacuum source for creating a vacuum within the system vacuum pipe;

constructing a static valve seal disposed between the receiving port and the vacuum pipe connection port, the static valve seal being adapted for coupling the system vacuum pipe to the vacuum hose to create substantially air-tight sealed communication between the system vacuum pipe and the vacuum hose so that the vacuum generated by the central vacuum source can be communicated through the vacuum hose to the vacuum cleaning tool;

the static valve seal comprising a radially deformable flexible sleeve adapted for sealed communication with the system vacuum pipe, the flexible sleeve being disposed for receiving the vacuum hose so that the vacuum hose can extend substantially coaxially through the flexible sleeve, into the system vacuum pipe; and wherein the flexible sleeve is adjustable to radially deform from a first non-deformed configuration, where the vacuum hose can move substantially freely through the valve assembly and into a system vacuum pipe, to a second radially deformed configuration where the flexible sleeve is radially deformed to constrict tightly around the vacuum hose to create substantially air-tight sealed communication between the vacuum hose and the system vacuum pipe, and wherein the movement from first non-deformed configuration to the second radially deformed configuration enables a user to select and fix the vacuum hose length that extends outward from the receiving port of the valve assembly.

15. The method for making a retractable hose central vacuum cleaning system as recited in claim 14 wherein the static valve seal further comprises means for radially deforming the flexible sleeve, said deforming means being movable from a first non-deforming configuration where the vacuum hose can move substantially freely through the valve assembly, to a second deformed configuration to deform the flexible sleeve to constrict tightly around the vacuum hose.

16. The method for making a retractable hose central vacuum cleaning system as recited in claim 15 wherein the deforming means comprises a clamp having an adjustable clamp band disposed around the flexible sleeve, the clamp band being movable from a first non-deforming configuration, where the vacuum hose can freely move through the valve assembly, to a second radially deformed configuration to radially deform the flexible sleeve to constrict tightly around the vacuum hose to form a substantially airtight seal between the vacuum hose and the system vacuum pipe.

17. The method for making a retractable hose central vacuum cleaning system as recited in claim 16 wherein the clamp further comprises a clamp lever, wherein the clamp band is responsive to the clamp lever being shifted from a first position where the clamp band in untensioned, to a second position where the clamp band is tensioned to radially deform the flexible sleeve to constrict tightly around the vacuum hose.

18. The method for making a retractable hose central vacuum cleaning system as recited in claim 14 wherein the step of constructing the static valve seal further comprises the step of:

forming a compression sleeve coaxially disposed around the flexible sleeve, the compression sleeve having a plurality of spaced, cantilevered compression elements encircling the flexible sleeve, each compression element extending along the flexible sleeve to define a radially outer surface that tapers in an axial direction; and forming an axially shiftable collet having a radially inner surface disposed around the compression sleeve, the collet being axially shiftable from a first position, where the radially inner surface thereof is disengaged from the compression elements, to a second engaging position where the radially inner surface of the collet engages the tapered surface of the compression elements causing the compression elements to bend toward the flexible sleeve, deforming the flexible sleeve to constrict tightly around the vacuum hose to create substantially air-tight sealed communication between the vacuum hose and the system vacuum pipe.

19. The method for making a retractable hose central vacuum cleaning system as recited in claim 18 wherein the compression sleeve further comprises a radially outer threaded portion, and the radially inner surface of the collet comprises a threaded portion to enable threaded engagement with the compression sleeve so that the collet can be rotated to shift from a first position, where the radially inner surface of the collet is disengaged from the compression elements, to a second engaging position where the radially inner surface of the collet engages the tapered surface of the compression elements causing the compression elements to bend toward the flexible sleeve, deforming the flexible sleeve to constrict tightly around the vacuum hose to create substantially air-tight sealed communication between the vacuum hose and the system vacuum pipe.

20. A retractable hose central vacuum cleaning system comprising:

a retractable vacuum hose having a tool end adapted to removably receive a vacuum cleaning tool for vacuuming debris, and an opposing retracting end;

a valve assembly having a receiving port for receiving the retracting end of the vacuum hose, wherein the vacuum hose is extendable through the receiving port and through the valve assembly;

the valve assembly further comprising:

a vacuum pipe connection port adapted to receive a system vacuum pipe that is in communication with a central vacuum source for creating a vacuum within the system vacuum pipe;

a static valve seal disposed between the receiving port and the vacuum pipe connection port, the static valve seal being adapted for coupling the system vacuum pipe to the vacuum hose to create substantially air-tight sealed communication between the system vacuum pipe and the vacuum hose so that the vacuum generated by the central vacuum source can be communicated through the vacuum hose to the vacuum cleaning tool;

the static valve seal comprising a radially deformable flexible sleeve adapted for sealed communication with the system vacuum pipe, the flexible sleeve being disposed for receiving the vacuum hose so that the vacuum hose can extend substantially coaxially through the flexible sleeve, into the system vacuum pipe; and wherein the flexible sleeve is adjustable to radially deform from a first non-deformed configuration, where the vacuum hose can move substantially freely through the valve assembly and into the system vacuum pipe, to a second radially deformed configuration where the flexible sleeve is radially deformed to constrict tightly around the vacuum hose to create substantially air-tight sealed communication between the vacuum hose and the system vacuum pipe, and, wherein the movement from first non-deformed configuration to the second radially deformed configuration enables a user to select and fix the vacuum hose length that extends outward from the receiving port of the valve assembly.

21. The retractable hose central vacuum cleaning system as recited in claim 20 further comprising a clamp having an adjustable clamp band disposed around the flexible sleeve, the clamp band being movable from a first non-deforming configuration, where the vacuum hose can freely move through the valve assembly, to a second radially deformed configuration to radially deform the flexible sleeve to constrict tightly around the vacuum hose to form a substantially air-tight seal between the vacuum hose and the system vacuum pipe.

22. The retractable hose central vacuum cleaning system as recited in claim 20 wherein the static valve seal further comprises:

a compression sleeve coaxially disposed around the flexible sleeve, the compression sleeve having a plurality of spaced, cantilevered compression elements encircling the flexible sleeve, each compression element extending along the flexible sleeve to define a radially outer surface that tapers in an axial direction; and an axially shiftable collet having a radially inner surface disposed around the compression sleeve, the collet being axially shiftable from a first position, where the radially inner surface thereof is disengaged from the compression elements, to a second engaging position where the radially inner surface of the collet engages the tapered surface of the compression elements causing the compression elements to bend toward the flexible sleeve, deforming the flexible sleeve to constrict tightly around the vacuum hose to create substantially air-tight sealed communication between the vacuum hose and the system vacuum pipe.

23. The retractable hose central vacuum cleaning system as recited in claim 22 wherein the compression sleeve further comprises a radially outer threaded portion, and the radially inner surface of the collet comprises a threaded portion to enable threaded engagement with the compression sleeve so that the collet can be rotated to shift from a first position, where the radially inner surface of the collet is disengaged from the compression elements, to a second engaging position where the radially inner surface of the collet engages the tapered surface of the compression elements causing the compression elements to bend toward the flexible sleeve, deforming the flexible sleeve to constrict tightly around the vacuum hose to create substantially air-tight sealed communication between the vacuum hose and the system vacuum pipe.

* * * * *